US005425600A

United States Patent [19]

Gordon

[11] Patent Number: 5,425,600

[45] Date of Patent: Jun. 20, 1995

[54] DRAINAGE BLOCK FEEDTHROUGH FOR ASSEMBLY OF WALLS CONSTRUCTED OF SPECIALIZED RETAINING BLOCKS

[76] Inventor: Bradford C. Gordon, 17 S. Riata Dr., Gilbert, Ariz. 85296

[21] Appl. No.: 184,028

[22] Filed: Jan. 21, 1994

[51] Int. Cl.[6] ..... E02D 29/02

[52] U.S. Cl. ..... 405/284; 405/36; 405/125; 405/286

[58] Field of Search ..... 405/36, 124, 125, 262, 405/284, 285, 286, 287

[56] References Cited

U.S. PATENT DOCUMENTS

| | | | |
|---|---|---|---|
| 1,098,766 | 6/1914 | Scully et al. | 405/125 |
| 1,228,662 | 6/1917 | Good | 405/125 |
| 3,123,939 | 3/1964 | Erickson | 50/70 |
| 3,338,254 | 8/1967 | Regal | 137/68 |
| 3,779,021 | 12/1973 | Green | 405/125 |
| 4,096,676 | 6/1978 | Hebert | 52/220 |
| 4,666,334 | 5/1987 | Karaus | 405/31 |
| 4,711,606 | 12/1987 | Leling et al. | 405/286 |
| 4,930,283 | 6/1990 | Andelfingen | 52/611 |
| 5,017,049 | 5/1991 | Sievert | 405/284 |

OTHER PUBLICATIONS

"Lawn Drain Headwall Detail", Keystone Retaining Wall Systems.

"Drainage Pipe Headwall Detail", Keystone Retaining Wall Systems.

*Primary Examiner*—David H. Corbin

*Attorney, Agent, or Firm*—Cahill, Sutton & Thomas

[57] ABSTRACT

A drain module is substituted for a retaining block during the construction of a retaining wall of interlocking retaining blocks to provide a drain. The drain module includes an inlet tube for coupling to a drainage pipe, a flange having an outer face attached to an end of the inlet tube, and an elongated main tube aligned with the inlet tube and attached to an inner face of the flange. A front face plate is attached to a front end of the main tube and has an opening aligned with a passage through the main tube. First and second side chambers are bounded by first and second portions, respectively, of the front face place extending beyond opposite sides of the main tube. In one embodiment the side chambers are filled with cement or the like during construction of the retaining wall to receive and anchor interlocking pins engaging retaining blocks of the retaining wall. The front face plate has a shape or contour closely corresponding to the shape or contour of the front face of each retaining block.

12 Claims, 1 Drawing Sheet

DRAINAGE BLOCK FEEDTHROUGH FOR ASSEMBLY OF WALLS CONSTRUCTED OF SPECIALIZED RETAINING BLOCKS

BACKGROUND OF THE INVENTION

The invention relates to a drain module or feedthrough module especially adapted for convenient incorporation into retaining walls constructed of interlocking retaining blocks.

Various manufacturers, including Keystone Retaining Wall Systems, Inc., of Minneapolis, Minn., Amastone Retaining Walls of Littleton, Colo., and Diamond Wall Block Systems Inc., of Brooklyn Park, Minn. manufacture and market specialized interlocking retaining blocks for construction of retaining walls which may be utilized to retain earthen terraces and the like. Frequently it is desirable that such retaining walls have one or more drains or feedthroughs.

Until now, the only known way of providing drains or feedthroughs in such retaining walls has been to "leave out" a few retaining blocks where the drain or feedthrough is needed and place a short section of ordinary pipe in the gap left by the omitted blocks and then fill the gaps between the section of pipe and the surrounding retaining blocks to provide a seal. This technique leaves much to be desired because (1) the prior technique does not conform to the interlocking scheme of the wall and leaves a potential weakness in the system, (2) the gaps filled with cement, grout, or other filler material do not match the face contour of the retaining blocks of which the retaining wall is constructed, (3) because of vibration, thermal cycling, etc. "slivers" of cement or filler usually break away, leaving unsightly gaps that require frequent repair, and (4) the prior technique is unsatisfactory from the viewpoint of construction cost, because considerably more labor is required to seal the feedthrough pipe section with the cement, grout, etc. than is required to lay an ordinary interlocking retaining block.

SUMMARY OF THE INVENTION

Accordingly, it is an object of the invention to provide a drain module or feedthrough module that is especially adapted for use in constructing retaining walls, especially those constructed of interlocking retainer blocks.

It is another object of the invention to provide a drain or feedthrough that will substantially maintain the structural integrity of the wall system.

It is another object of the invention to provide a drainage block feedthrough having a front face that substantially matches the front faces of interlocking retaining blocks of which a retaining wall is constructed.

It is another object of the invention to provide an attractive, reliable drain module or feedthrough module that does not require cement or the like to seal gaps between the module and adjacent retaining blocks of which the retaining wall is constructed.

It is another object of the invention to reduce the labor costs involved in constructing a retaining wall of interlocking retaining blocks.

It is another object of the invention to reduce the amount of maintenance needed for a retaining wall having drains or feedthroughs.

Briefly described, and in accordance with one embodiment thereof, the invention provides a drain module for replacing a retaining block (or blocks) during the construction of a retaining wall of interlocking retaining blocks each having a front face. The drain module includes a cylindrical inlet tube adapted to be coupled to a drainage pipe, a flange having an outer face attached to an end of the inlet tube, and an elongated main tube aligned with and in open communication with the end of the inlet tube. The main tube has a rear end attached to an inner face of the flange. A front face plate is attached to a front end of the main tube and has an opening aligned with a passage through the main tube. The front plate has a length and width approximately equal to a length and width, respectively, of the front face of a retaining block. First and second side chambers are bounded by first and second portions, respectively, of the front face plate extending beyond opposite sides of the main tube. The side chambers are filled with cement or the like during construction of the retaining wall. The first and second chambers have open upper and lower ends and are bounded by walls that generally match or are coextensive with walls of a front section of a retaining block. The front face plate has a shape or contour closely corresponding to the shape or contour of the front face of each retaining block.

DETAILED DESCRIPTION OF THE PREFERRED EMBODIMENTS

Figure 1:
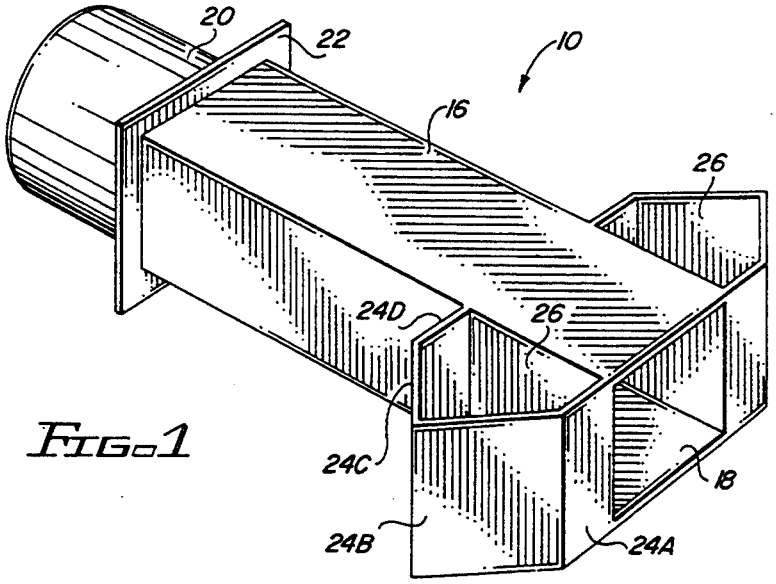
FIG. 1 is a perspective view of one embodiment of the drain module of the present invention.
Figure 2:
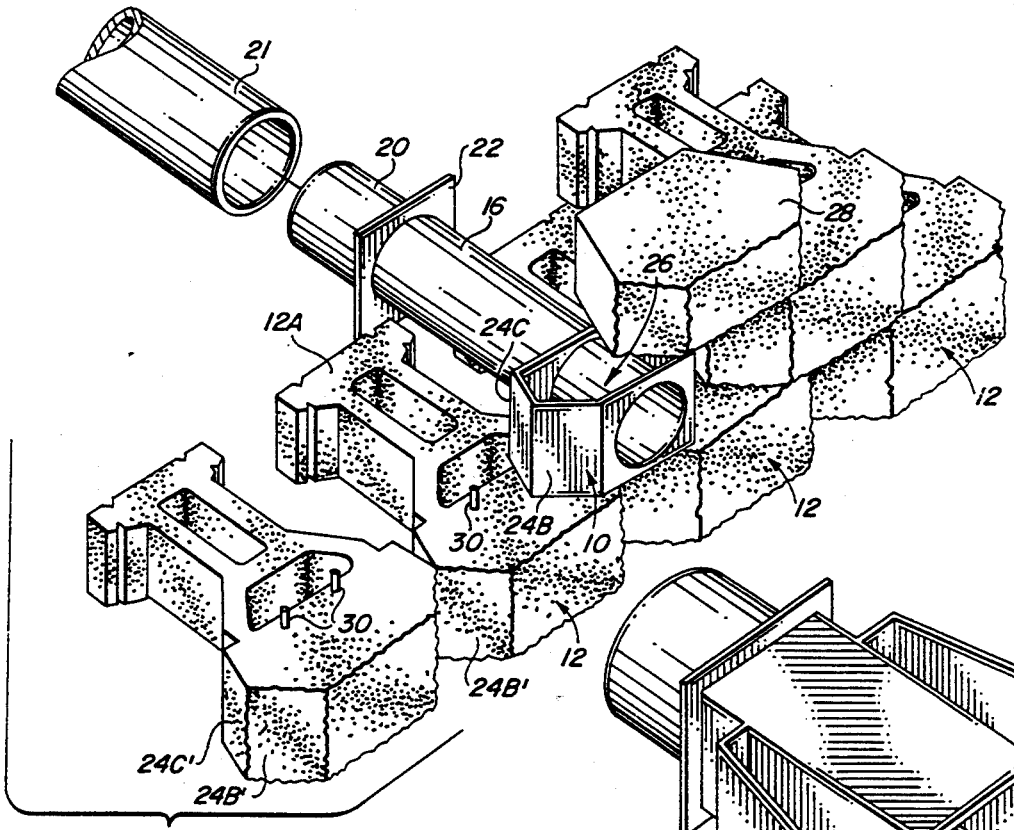
FIG. 2 is a perspective view illustrating another embodiment of the drain block feedthrough of the present invention positioned in a retaining wall being constructed of specialized retaining blocks.

Referring to FIG. 1, drain module 10 includes a short cylindrical inlet tube or adapter 20 that is attached in sealed relationship with one face of a transverse rectangular flange 22 having a hole aligned with inlet tube 20. Inlet 20 typically is connected to a pipe that leads to a "catch basin" into which a terraced region drains. The opposite face of flange 22 is attached in sealed relationship to an elongated main tube 16, which preferably is of rectangular cross section as shown in FIG. 1 or round cross section as shown in FIG. 2. A passage 18 through feedthrough 16 is, of course, in open communication with inlet tube 20. The diameter of inlet tube 20 is selected to be conveniently coupled to any particular standard iron or PVC pipe.

A pair of "side chambers" 26 are attached to opposite sides of the front end of main tube 16. Each chamber 26 is formed by a pair of walls 24A, 24B, 24C, and 24D. Front wall 24A extends from the side of main tube 16 to the edge of inclined wall 24B. Inclined wall 24C extends from the left edge of wall 24B to the edge of wall 24D. Wall 24D engages or seals against the side of main tube 16. These walls 24B and 24C are of the same size and orientation as the walls 24B' and 24C' (FIG. 2) of the front section of a retaining block. The upper and lower ends of each chamber 26 are open so they can be filled with cement or suitable filler material during construction of a retaining wall with drain module 10. The shape or contour of the front face formed by the front wall sections 24A and 24B substantially matches the shape or contour of the front face of interlocking retaining blocks manufactured by Keystone Retaining Wall Systems, Inc., Amastone Retaining Walls, and others.

FIG. 2 shows a slightly different embodiment of drain block feedthrough 10 which differs from the one shown in FIG. 1 in that its main tube 16 has a circular, rather than rectangular cross section.

In FIG. 2, drain module 10 is positioned to overlap two adjacent interlocking retaining blocks 12 of the next lower row in a partially constructed retaining wall. The retaining blocks illustrated are of the type manufactured by Keystone Retaining Wall Systems, Inc. The retaining blocks 12 have enlarged front sections which include side walls 24B' and 24C' and smaller rear or tail sections to allow convenient construction of curved retaining walls which can follow the contour of a terrace or the like being retained. Retaining blocks 12 each include holes in their upper surfaces from which a pair of anchor or interlocking pins 30 extend. The pins 30 of a retaining block 12 fit into arcuate slots in the bottoms of two overlapping retaining blocks of the overlying row in order to anchor or interlock the rows of the completed retaining wall together.

In accordance with the present invention, drain module 10 is simply positioned to replace a retaining block 12 wherever a drain or feedthrough is needed. The interlock pins 30 of two adjacent blocks of the supporting row extend into its two side chambers 26. Cement or grout is poured into chambers 26, and when cured forms a bond with pins 30. Flange 22 provides a base against which a drain connection pipe 21 seats and also provides stability from lateral movement.

After the row including drain module 10 is installed, the next row of retaining block 10 can be laid in the usual manner. If desired, cap blocks such as 28 can be utilized for the top row of the retaining wall.

The above-described drainage block modules can be formed of suitable material such as steel or a ceramic or plastic. The steel drain block modules can be painted with suitable rustproof metal paint to match the color of the retaining wall being constructed. The various dimensions can be easily selected to match the dimensions of the retaining blocks of which the retaining wall is to be constructed. The face of the drain or feedthrough can be texturized to more closely match the block being used. Use of the above described drain modules substantially maintains the integrity and strength of the retaining wall system.

Substantial labor savings are gained in construction of retaining walls requiring drainage pipes using the above described drain modules. Such savings can partly or completely pay for the cost of the above-described drain modules.

Figure 3:
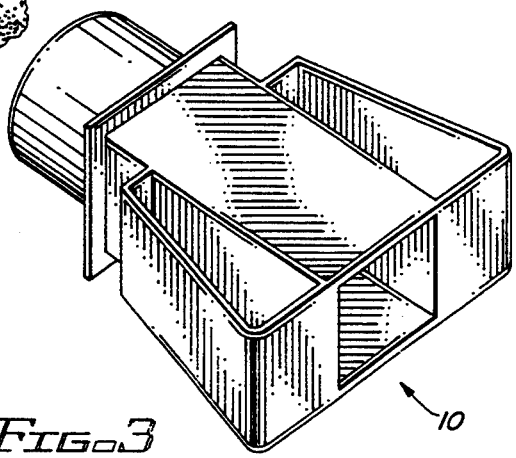
FIG. 3 is a perspective view of another drain module of the present invention.

FIG. 3 shows another drain module adapted for use in construction drains in retaining walls constructed of Amastone interlocking retaining blocks. The Amastone retaining blocks do not utilize pins 30, and instead are interlocked by means of a lip on the rear portion of each block.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A drain module for replacing a retaining block during the construction of a retaining wall of interlocking retaining blocks each having a front face, the drain module comprising in combination:

(a) a cylindrical inlet tube adapted to be coupled to a drainage pipe;

(b) a flange having an outer face attached to an end of the inlet tube;

(c) an elongated main tube aligned with and in open communication with the end of the inlet tube, the main tube having a rear end attached to an inner face of the flange; and (d) a front face plate attached to a front end of the main tube, the front face plate having an opening aligned with a passage through the main tube, the front plate having a length and a width approximately equal to a length and a width, respectively, of the front face of a retaining block.

2. The drain module of claim 1 including first and second side chambers bounded by first and second portions, respectively, of the front face plate extending beyond opposite sides of the main tube, the first and second side chambers being filled with cement or the like during construction of the retaining wall.

3. The drain module of claim 2 wherein the first and second side chambers have open upper and lower ends and are bounded by walls that generally match walls of a front section of a retaining block.

4. The drain module of claim 3 wherein the main tube has a rectangular cross section.

5. The drain module of claim 3 wherein the main tube has a circular cross section.

6. The drain module of claim 3 composed of steel.

7. The drain module of claim 3 composed of plastic.

8. The drain module of claim 3 composed of ceramic.

9. The drain module of claim 3 wherein the front face of each retaining block has a predetermined shape or contour, the front face plate having a shape or contour closely corresponding to that of the front face of each retaining block.

10. A feed-through module for replacing a retaining block in constructing a retaining wall of interlocking retaining blocks each having a front face, the drain module comprising in combination:

(a) a flange for engaging rear faces of a plurality of adjacent retaining blocks;

(b) a main tube having a rear end attached to an inner face of the flange, the flange having an opening aligned with the rear end of the main tube;

(c) a front face plate attached to a front end of the main tube, the front face plate having an opening aligned with a passage through the main tube, the front face plate having a length and a width approximately equal to a length and a width of the front face, respectively, of a retaining block.

11. A method of constructing a retaining wall of interlocking retaining blocks, the method comprising the steps of:

(a) laying a first row of the retaining blocks;

(b) laying part of a second row of the retaining blocks on the first row;

(c) providing a drain module including i. a cylindrical inlet tube adapted to be coupled to a drainage pipe ii. a flange having an outer face attached to an end of the inlet tube iii. an elongated main tube aligned with and in open communication with the end of the inlet tube, the main tube having a rear end attached to an inner face of the flange;

(d) placing the drain module on the first row adjacent to a first retaining block of the second row, and placing a second retaining block on the first row adjacent to the drain module, and laying the rest of the second row, the drain module being part of the second row; and (e) laying a continuous third row of the retaining blocks on the second row.

12. The method of claim 11 wherein the drain module includes first and second side chambers bounded by first and second portions, respectively, of the front face plate extending beyond opposite sides of the main tube, the method including filling the first and second side chambers with cement or the like to receive interlocking pins for engaging retaining blocks of the first and third rows before performing step (e).

* * * * *